US006810895B2

(12) United States Patent
Lin et al.

(10) Patent No.: US 6,810,895 B2
(45) Date of Patent: Nov. 2, 2004

(54) UMBRELLA HAVING SAFETY RUNNER AND STRENGTH-ENHANCED SHAFT TUBE

(75) Inventors: Chung-Kuang Lin, Taipei Hsien (TW); Jung-Jen Chang, Taipei Hsien (TW)

(73) Assignee: Fu Tai Umbrella Works, Ltd., Taipei Hsien (TW)

( * ) Notice: Subject to any disclaimer, the term of this patent is extended or adjusted under 35 U.S.C. 154(b) by 59 days.

(21) Appl. No.: 10/199,171

(22) Filed: Jul. 22, 2002

(65) Prior Publication Data

US 2004/0011391 A1 Jan. 22, 2004

(51) Int. Cl.[7] ..... A45B 25/06
(52) U.S. Cl. ..... 135/28
(58) Field of Search ..... 135/28, 38, 39, 135/40, 41

(56) References Cited

U.S. PATENT DOCUMENTS 5,964,235 A * 10/1999 Wang ..... 135/28
6,371,141 B1 * 4/2002 Lin et al. ..... 135/28
6,539,964 B1 * 4/2003 Ko ..... 135/28
6,571,813 B2 * 6/2003 Lin et al. ..... 135/28
2002/0179130 A1 * 12/2002 Ko ..... 135/39

FOREIGN PATENT DOCUMENTS

DE 232949 * 3/1911 ..... 135/28
FR 619062 * 12/1926 ..... 135/28

* cited by examiner

*Primary Examiner*—Janet M. Wilkens
(74) *Attorney, Agent, or Firm*—Troxell Law Office PLLC

(57) ABSTRACT

An umbrella includes: a spring catch secured on an upper portion of a central shaft of the umbrella, and a runner slidably held on the central shaft to be engaged with the spring catch when opening the umbrella, with the spring catch juxtapositionally positioned and operated outside the central shaft without cutting a catch slit or slot through a tube of the central shaft as found in a conventional umbrella having the spring catch retained within the central shaft and protruding outwardly through the catch slit for locking the runner, thereby enhancing the strength of the tube of the central shaft and prolonging the service life of the umbrella.

7 Claims, 4 Drawing Sheets

UMBRELLA HAVING SAFETY RUNNER AND STRENGTH-ENHANCED SHAFT TUBE

BACKGROUND OF THE INVENTION

The same inventor of this application had invented a safety umbrella runner ergonomically operated by sliding push button in his U.S. Pat. No. 6,371,141 having the push button slidably held in the runner; whereby upon depression of the push button, a spring catch as resiliently held in the central shaft of the umbrella and as outwardly protruding through the shaft will be disengaged from a catch slit formed through the shaft for unlocking the runner on the shaft in order for closing the umbrella.

However, the catch slit as cut through the tube of the central shaft may weaken the mechanical strength of the shaft to easily twist, deform, break or damage the umbrella, thereby shortening the service life of the umbrella.

The present inventor has found the drawbacks of the conventional umbrella and invented the present umbrella with safe runner and strong shaft tube.

SUMMARY OF THE INVENTION

The object of the present invention is to provide an umbrella including: a spring catch secured on an upper portion of a central shaft of the umbrella, and a runner slidably held on the central shaft to be engaged with the spring catch when opening the umbrella, with the spring catch juxtapositionally positioned and operated outside the central shaft without cutting a catch slit or slot through a tube of the central shaft as found in a conventional umbrella having the spring catch retained within the central shaft and protruding outwardly through the catch slit for locking the runner, thereby enhancing the strength of the tube of the central shaft and prolonging the service life of the umbrella.

DETAILED DESCRIPTION

Figure 1:
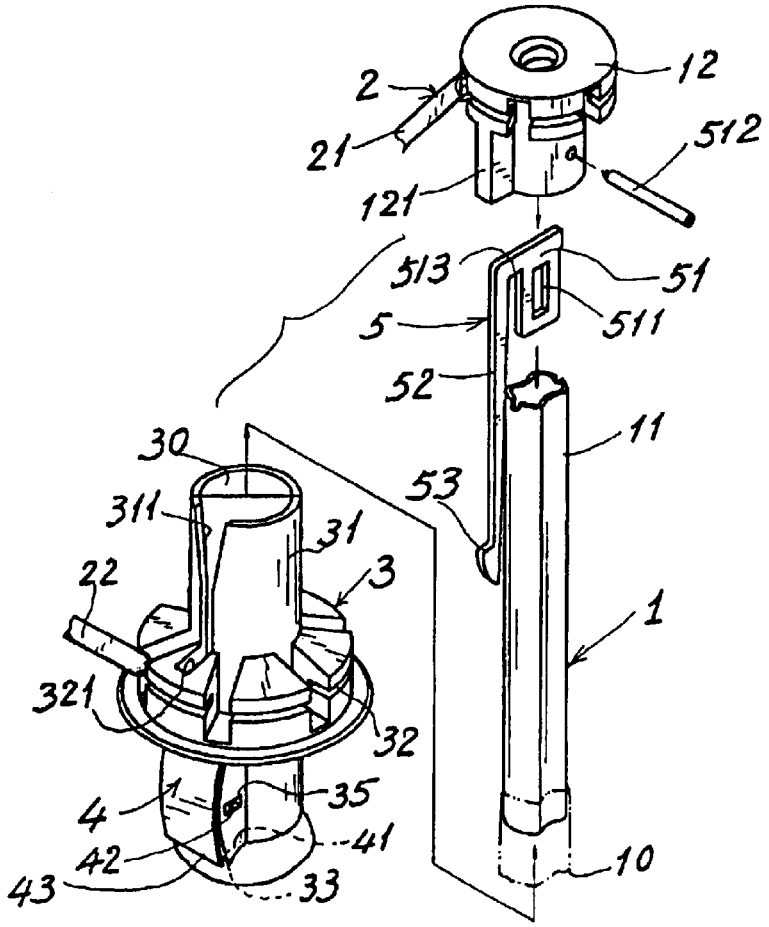
FIG. 1 is an exploded view showing the elements of the present invention.
Figure 2:
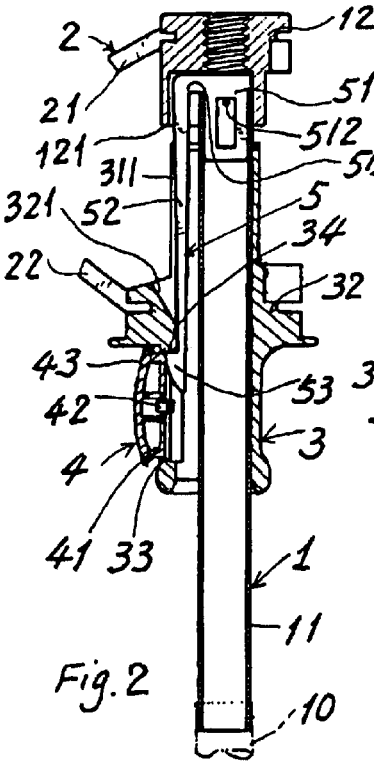
FIG. 2 is a sectional drawing of the present invention when opening the umbrella.

As shown in FIGS. 1~5, the present invention comprises: a central shaft 1 having at least an upper tube 11 telescopically engageable with a lower tube 10 and an upper notch 12 formed on a top of the upper tube 11; a rib assembly 2 having at least a top rib 21 pivotally secured to the upper notch 12 and a stretcher rib 22 pivotally connected between the top rib 21 and a runner (or lower runner) 3 slidably held on the central shaft 1; a push button 4 slidably formed on the runner 3; and a spring catch 5 secured on an upper portion of the upper tube 11 of the central shaft 1 and protruding downwardly to be engaged with the runner 3 when opening the umbrella for locking the runner 3 and the rib assembly 2 at an opening state of the umbrella.

The spring catch 5 as formed on the upper or top portion of the central shaft 1 is juxtapositionally positioned outside the shaft 1 to be engaged with or disengaged from the runner 3; and the spring catch 5 is not formed within the central shaft 1 so that there is no catch slit or slot cut through the upper tube 11 of the shaft 1 to influence or weaken the strength of the tube of the shaft 1. In other words, the strength of the shaft tube can then be enhanced in comparison with the conventional umbrella.

The present invention may be used for multiple-fold umbrella, such as two folds, three folds and including multiple-fold tubes of the shaft 1 and multiple-fold ribs of the rib assembly 2, not limited in this invention.

The runner (or lower runner) 3 includes: a cylinder 31 having a central hole 30 slidably engageable with the central shaft 1, a ferrule 32 integrally formed on the cylinder 31 for pivotally securing the stretcher ribs 22 thereon, a button slot 33 transversely formed through the runner 3 to be slidably engageable with the push button 4, an engaging shoulder portion 34 formed on an inner portion of the button slot 33 to be engaged with the spring catch 5 when opening the umbrella, a pair of lug slots 35 transversely formed in opposite side portions of the runner 3 to be slidably engageable with a pair of lugs 42 formed on opposite sides of the push button 4, and a guiding slot 311 longitudinally formed in the cylinder 31 and tapered downwardly to guide the spring catch 5 downwardly inwardly to be engaged and locked with the engaging shoulder portion 34 of the runner 3.

The runner 3 further includes a sloping groove 321 formed in the ferrule 32 and sloping downwardly inwardly to be communicated with the guiding slot 311 and communicated with the central hole 30 in the runner 3 to help a downward moving of the spring catch 5 to be engaged with the shoulder portion 34 of the runner 3.

Figure 3:
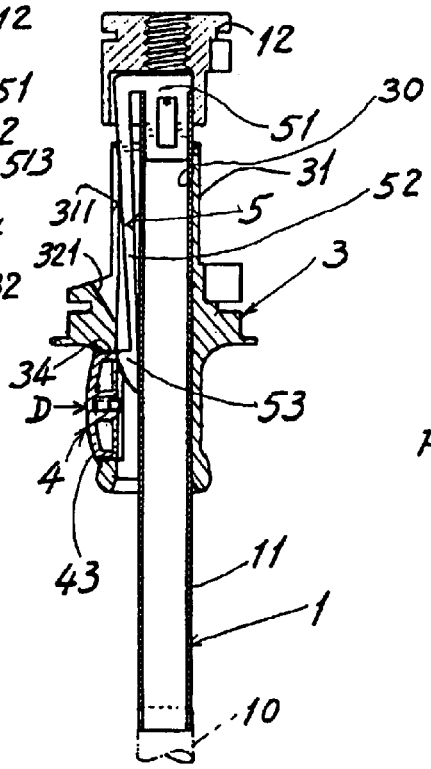
FIG. 3 is a sectional drawing when depressing the push button for unlocking the runner when closing the umbrella.

The push button 4 includes: a plunger 41 slidably engageable with the button slot 33 of the runner 3, a pair of lugs 42 slidably engageable with the lug slots 35 in the runner 3, and a button plate 43 formed on an outer portion of the plunger 41, whereby upon an inward depression (D) of the push button 4 when unlocking the runner 3 for closing the umbrella, the button plate 43 will be retarded against an outer end wall of the button slot 33 of the runner 3 (FIG. 3).

Naturally, the present invention may also be modified to eliminate the push button 4; and the spring catch 5 may then be directly engaged with a lower rim or a catch groove as formed in the runner (not shown).

Other modifications of the runner 3, the push button 4 and the spring catch 5 may be further made in accordance with the present invention, except the preferred embodiments as illustrated in the drawings accompanying herewith.

The spring catch 5 may be made of elastic materials including steel, plastic or any other metals or alloys having good resilience.

The spring catch 5 includes: a fixing base portion 51 secured on an upper or top portion of the upper tube 11 of the central shaft 1, an arm member 52 protruding downwardly from the fixing base portion 51 to be juxtapositioned to a tube wall of the upper tube 11, and a catch portion 53 formed on a lower end of the arm member 52 to be engaged with the engaging shoulder 34 of the runner 3 for locking the runner 3 and the rib assembly 2 at their opening state.

The fixing base portion 51 of the spring catch 5 includes: a pin hole 511 formed in the fixing base portion 51 to be inserted with a pin 512 through the upper tube 11 and the upper notch 12 for firmly fixing the base portion 51 on the upper portion of the upper tube 11, and an embedding portion 513 transversely formed on the base portion 51 to be embedded in an upper end portion of the upper tube 11.

The upper notch 12 further includes: a cap portion 121 for accommodating and limiting the base portion 51 of the spring catch 5 within the cap portion 121.

Naturally, the base portion 51 of the spring catch 5 may also be directly secured to the upper notch 12 which is deadly fixed on the top of the shaft 1.

When opening the umbrella by raising the runner 3 upwardly along the shaft 1 to allow the shoulder portion 34 of the runner 3 to be engaged with the catch portion 53 of the spring catch 5 (FIG. 2), the runner 3 will be locked by the catch 5 for stably opening the umbrella.

Since the spring catch 5 is not provided in the interior in the shaft 1, there is no need to cut a catch slit (or slot) through the shaft tube as usually done in a conventional umbrella. So, the shaft tube 11 of the present invention is not cut or broken, thereby maintaining its strong mechanical strength, including anti-twisting strength; and prolonging the service life of the umbrella.

Figure 4:
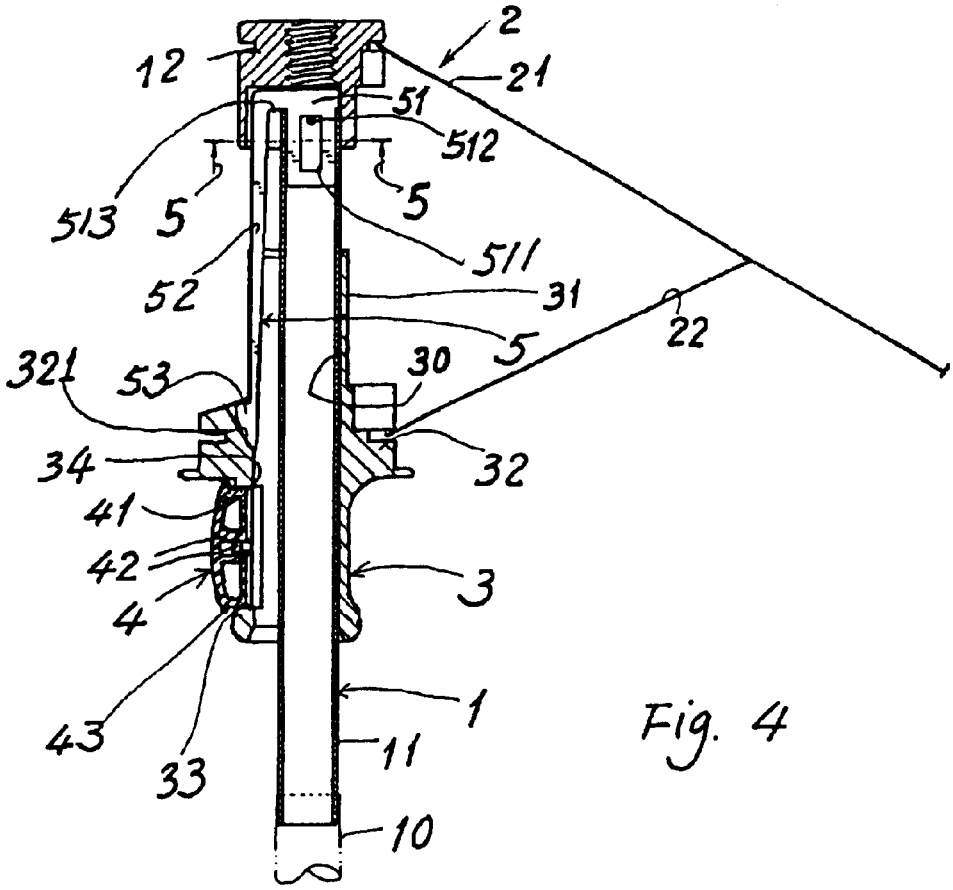
FIG. 4 is a sectional drawing when unlocking the runner from FIG. 3.
Figure 5:
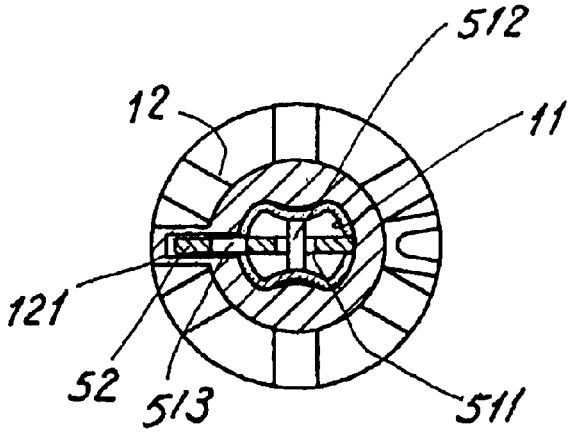
FIG. 5 is a cross sectional drawing when viewed from line 5—5 of FIG. 4.

Upon depression of the push button 4 to disengage the shoulder portion 34 from the catch portion 53 of the spring catch 5, the runner 3 will then be unlocked in order to close the umbrella as shown in FIGS. 3, 4.

Figure 6:
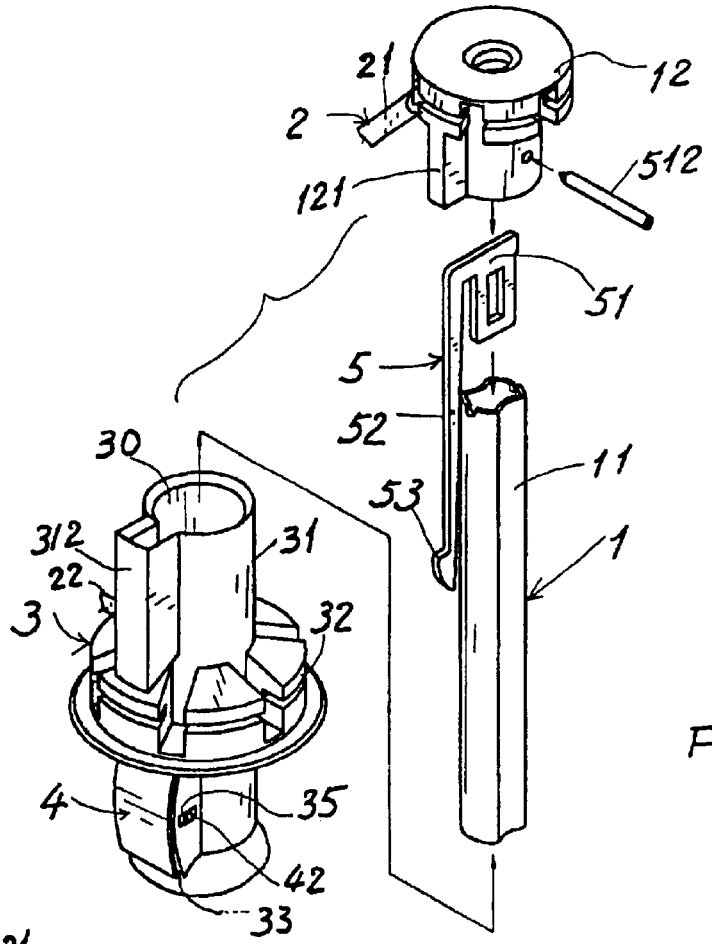
FIG. 6 is an exploded view of another preferred embodiment of the present invention.
Figure 7:
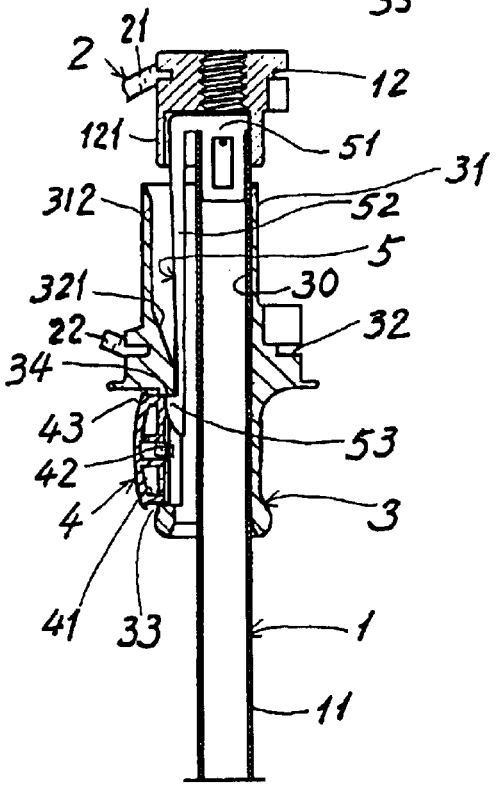
FIG. 7 is a sectional drawing of the present invention when opening of the umbrella.

As shown in FIGS. 6, 7, a minor modification is made in this invention by forming a guiding tube portion 312 on the cylinder 31 of the runner 3 for guiding the catch portion 53 of the spring catch 5 downwardly through the tube portion 312 to be engaged with the shoulder portion 34 of the runner 3 when opening the umbrella. Similarly, a sloping groove 321 is taperingly formed in the tube portion 312 to guide the catch portion 53 downwardly in order to be smoothly engaged with the shoulder portion 34 of the runner 3.

Figure 8:
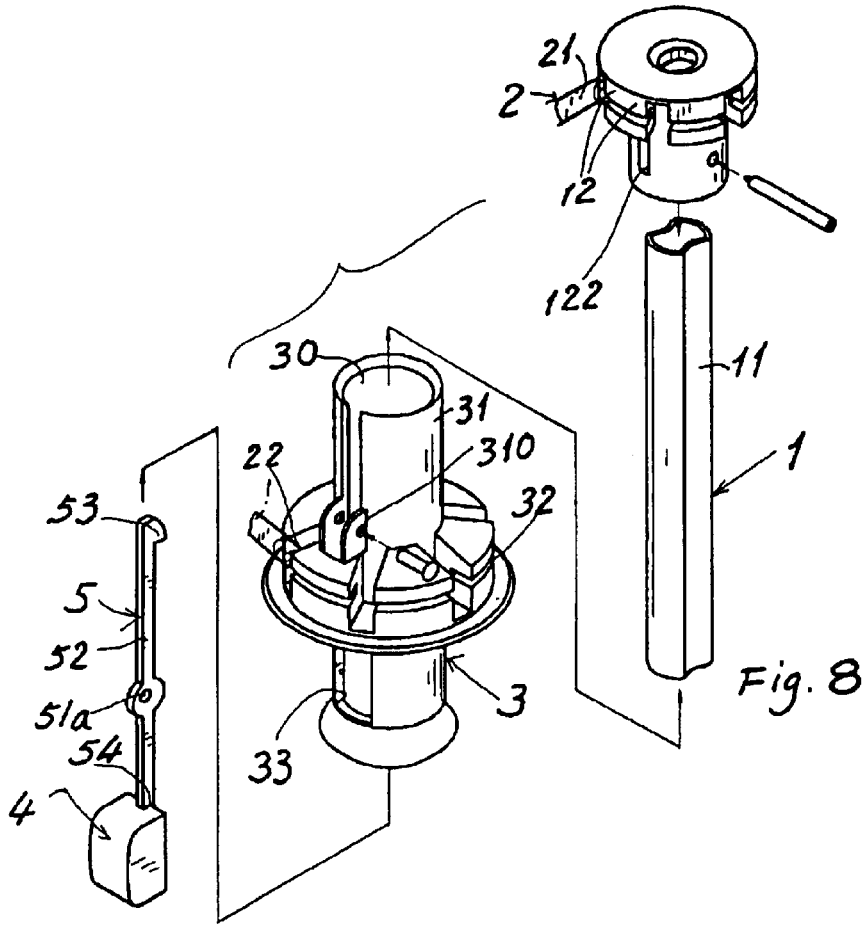
FIG. 8 shows still another preferred embodiment of the present invention.
Figure 9:
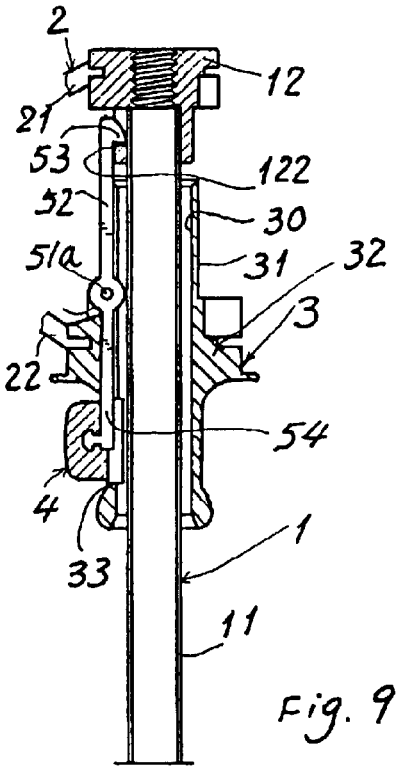
FIG. 9 is a sectional drawing of the present invention when opening the umbrella.
Figure 10:
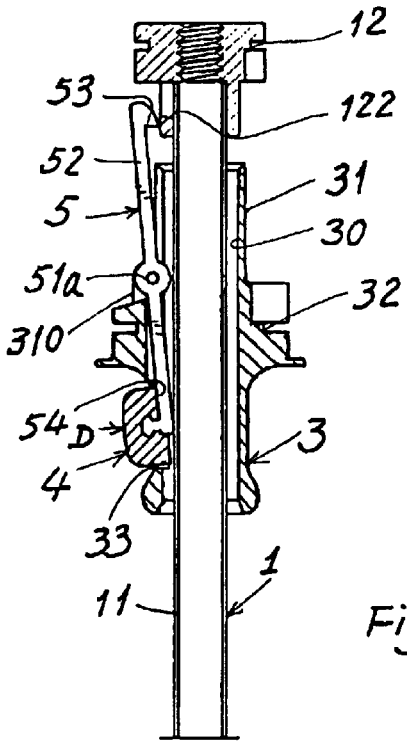
FIG. 10 is a sectional drawing when unlocking the runner from the shaft following FIG. 9.

Still another preferred embodiment of the present invention is shown in FIGS. 8~10.

The spring catch 5 includes: a lever arm member 52 having a pivotal portion 51*a* formed on a middle portion of the lever arm member 52 and pivotally mounted on a middle portion 310 of the runner 3, a catch portion 53 formed on an upper end portion of the arm member 52 and operatively engaged with a catch cavity 122 formed in the upper notch 12 on a top of the central shaft 1 when opening the umbrella (FIG. 9), and a lower end portion 54 of the arm member 52 secured thereon with a push button 4 slidably held in a button slot 33 formed in the runner; whereby upon depression of the push button 4 to bias the lever arm member 52 to disengage the catch portion 53 from the catch cavity 122 in the upper notch 12, the runner 3 will then be unlocked from the spring catch 5 and lowered along the shaft 1 for closing the umbrella (FIG. 10). The spring catch 5 is slidably juxtapositioned to the shaft without cutting a catch slit on the shaft for enhancing the shaft strength.

The present invention may be modified without departing from the spirit and scope of the present invention.

We claim:

1. An umbrella comprising:

a central shaft including an upper notch formed on a top of said shaft;

a rib assembly including at least a top rib pivotally secured to the upper notch, and a stretcher rib pivotally connected to said top rib;

a runner pivotally connected with said stretcher rib and slidably held on said central shaft; and a spring catch secured to a top portion of said central shaft adjacent to said upper notch on said shaft; said spring catch protruding downwardly from said upper notch to be operatively engaged with said runner when opening the umbrella; and said spring catch juxtapositioned to said shaft as positioned outside said shaft for preventing cutting of a catch slit in said shaft for preventing weakening of mechanical strength of said shaft; and said runner including: a cylinder having a central hole slidably engageable with the central shaft, a ferrule integrally formed on the cylinder for pivotally securing the stretcher rib thereon, a button slot transversely formed through the runner to be slidably engageable with a push button, an engaging shoulder portion formed on an inner portion of the button slot to be engaged with the spring catch when opening the umbrella, a pair of lug slots transversely formed in opposite side portions of the runner to be slidably engageable with a pair of lugs formed on opposite sides of the push button, and a guiding slot longitudinally formed in the cylinder and tapered downwardly to guide the spring catch downwardly inwardly to be engaged and locked with the engaging shoulder portion of the runner.

2. An umbrella according to claim 1, wherein said runner further includes a sloping groove formed in the ferrule and sloping downwardly inwardly to be communicated with the guiding slot and with the central hole in the runner to help a downward moving of the spring catch to be engaged with the shoulder portion of the runner.

3. An umbrella according to claim 1, wherein said central shaft includes at least an upper tube, and a lower tube telescopically engaged with said upper tube, having said upper notch formed on a top of said upper tube, and having said runner slidably held on said shaft for engaging the spring catch for locking the runner and the rib assembly when opening the umbrella.

4. An umbrella according to claim 3, wherein said spring catch includes: a fixing base portion secured on an upper portion of said upper tube, an arm member protruding downwardly from the fixing base portion to be juxtapositioned to a tube wall of the upper tube, and a catch portion formed on a lower end of the arm member to be engaged with the engaging shoulder of the runner for locking the runner and the rib assembly at an opening state of the umbrella.

5. An umbrella according to claim 4, wherein said fixing base portion of the spring catch includes: a pin hole formed in the fixing base portion to be inserted with a pin through the upper tube and the upper notch for firmly fixing the base portion on the upper portion of the upper tube, and an embedding portion transversely formed on the base portion to be embedded in an upper end portion of the upper tube.

6. An umbrella according to claim 5, wherein said upper notch further includes: a cap portion for accommodating and limiting the base portion of the spring catch within the cap portion.

7. An umbrella according to claim 1, wherein said runner further includes a guiding tube portion formed on the cylinder of the runner for guiding a catch portion of the spring catch downwardly through the guiding tube portion to be engaged with the shoulder portion of the runner when opening the umbrella.

* * * * *